US006561503B1

(12) United States Patent
Ogata et al.

(10) Patent No.: US 6,561,503 B1
(45) Date of Patent: May 13, 2003

(54) SHEET PROCESSING DEVICE WITH STACK ALIGNMENT

(75) Inventors: Atsushi Ogata, Shizuoka-ken (JP); Teruo Komatsu, Mishima (JP); Yasuyoshi Hayakawa, Mishima (JP); Tsuyoshi Waragai, Mishima (JP); Tomoyuki Araki, Numazu (JP); Masayoshi Fukatsu, Shizuoka-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/604,741

(22) Filed: Jun. 28, 2000

(30) Foreign Application Priority Data

Jun. 29, 1999 (JP) ..... 11-183453

(51) Int. Cl.[7] ..... B65H 37/04

(52) U.S. Cl. ..... 270/58.12; 270/58.08; 271/248; 271/250

(58) Field of Search ..... 271/226, 241, 271/248, 250, 246, 242, 245; 270/58.07, 58.08, 58.4, 58.12

(56) References Cited

U.S. PATENT DOCUMENTS 4,073,391 A * 2/1978 O'Brien et al. ..... 271/246 X
4,898,372 A * 2/1990 Hirabayashi et al. .... 270/58.12
5,069,442 A * 12/1991 Storz ..... 271/250
5,540,423 A * 7/1996 Nakano ..... 271/242 X
5,782,466 A * 7/1998 Regimbal et al. ..... 270/58.08
5,826,158 A * 10/1998 Hirano et al. ..... 270/58.08 X
5,992,846 A * 11/1999 Umeda ..... 271/248

* cited by examiner

*Primary Examiner*—Patrick H. Mackey
(74) *Attorney, Agent, or Firm*—Fitzpatrick, Cella, Harper & Scinto

(57) ABSTRACT

A sheet processing apparatus including a stacking portion for stacking sheets, an alignment reference wall disposed in approximately parallel with a conveying direction of the sheet, an alignment moving wall for performing alignment by making an end portion of the sheet hit with the alignment reference wall, a processing mechanical section for carrying out binding with respect to the sheet bundle thus aligned, and a plurality of rotating pairs disposed in a widthwise direction approximately perpendicular to the conveying direction of the sheet for conveying the sheet bundle in a pinching manner. The sheet processing apparatus is capable of performing a process such as binding in the processing mechanical section after the sheet bundle which has been aligned by the alignment reference wall and the alignment moving wall is conveyed by a predetermined distance by the rotating pairs, and it is characterized in that each of the plurality of the rotating pairs disposed in the sheet widthwise direction has a pressure different from that of other rotating pairs for pinching the sheet.

6 Claims, 9 Drawing Sheets

SHEET PROCESSING DEVICE WITH STACK ALIGNMENT

BACKGROUND OF THE INVENTION

1. Field of the Invention

The present invention relates to a sheet processing apparatus capable of binding in a plurality of spots of a sheet bundle by conveying the sheet bundle with alignment property maintained, and, to a sheet processing apparatus used in an image forming apparatus, for example, such as a printer, a copying machine or the like.

2. Description of the Prior Art

In a conventional sheet-bundle binding apparatus, a binding mechanical section is moved along a sheet bundle aligned on a stacking tray as a sheet stacking portion so that an arbitrary position of a sheet end portion is to be bound. For example, as a sheet-bundle binding apparatus provided in an image forming apparatus such as a copying machine or the like, some have such a structure in which, after a sheet on which a toner image is recorded by an image forming section is conveyed to a stacking tray where a predetermined number of sheets is aligned, a binding mechanical section is moved to a predetermined position of an end portion of the sheet bundle thus aligned on the stacking tray to perform the binding process.

This sheet-bundle binding apparatus, however, is required to move the binding mechanical section by a distance corresponding to various sizes of sheets, since an arbitrary position of the end portion of the sheet bundle is to be bound. This results in not only that a structure of the sheet-bundle binding apparatus becomes complicated, but also that a rate of breakdown occurrence becomes higher due to the movement of the binding mechanical section. In addition, a space for moving the binding mechanical section is required, so miniaturization of the apparatus becomes difficult. As a result, the conventional sheet-bundle binding apparatus has such problems as that manufacturing at a lower cost is difficult, and that a broader area is required for installing the image forming apparatus including the sheet-bundle binding apparatus.

In order to solve such problems, there has been proposed an apparatus in which a binding mechanical section is fixed and a sheet bundle is conveyed to a predetermined position with respect to the binding mechanical section, thereby capable of performing the similar binding process of the sheet bundle. This apparatus can make the structure of the binding mechanical section simple and make the rate of breakdown occurrence of the binding mechanical section lower.

In the foregoing conventional apparatus, however, it is required to move the aligned sheet bundle for performing the binding process, and therefore alignment property becomes deteriorated during the conveyance of the sheet bundle, so there is a problem that alignability of the sheet bundle is lower when compared with the alignability of such a type of an apparatus where the binding mechanical section is moved.

SUMMARY OF THE INVENTION

Thus, the present invention has been accomplished to solve the aforementioned problems, and it is an object of the present invention to provide a sheet processing apparatus capable of preventing deterioration of alignment property during conveyance of a sheet bundle which has been aligned but before subjected to a binding process and capable of binding the sheet bundle with high alignability.

In a sheet processing apparatus including, as a representative structure of the present invention to accomplish the above object, a stacking portion for stacking a plurality of sheets to be made as a sheet bundle, an alignment reference wall extending in approximately parallel with a conveying direction of the sheet bundle on one side of side surfaces of the sheet bundle, a processing mechanical section for treating an aligned sheet bundle, and a plurality of rotating body pairs disposed in a direction approximately perpendicular to the conveying direction of the sheet bundle for conveying the sheet bundle in a pinching manner, it is characterized in that the rotating body pairs have different pressures for pinching the sheet bundle.

According to the present invention, as mentioned above, since it is so structured that each of the plural rotating means pairs arranged in a widthwise direction perpendicular to a sheet conveying direction has a pressure different from that of other rotating means pairs for respectively pinching a sheet bundle, and more specifically that, as a rotating means pair is disposed nearer an alignment reference wall, the roller pair has a higher pressure for pinching the sheet bundle, a sheet bundle before subjected to the binding process, at the time of being conveyed, can be conveyed as being pressed with respect to the alignment reference wall, with the result that the aligned sheet bundle can be conveyed with the aligned state maintained. Thus, the sheet bundle can certainly conveyed without disordering the alignment property of the sheet, and also processes such as binding or the like can be performed without disordering the alignment.

Thus, since the alignment property of the sheet bundle is maintained, a mechanism for moving a stapler unit and the space for the mechanism, which have been conventionally required, can be omitted, thereby realizing a simplification of the apparatus as a whole and reductions in cost, installation space, and power consumption.

More specifically, it is characterized in that, for example, with respect to the plural roller pairs disposed, as a roller pair is disposed nearer the side of the alignment reference wall, the roller pair has a higher pressure for pinching the sheet.

According to the above structure, at the time of conveying a sheet bundle, which has been aligned but not subjected to the binding process, the sheet bundle is conveyed as being pressed with respect to the alignment reference wall, and consequently, this can lower the deterioration of the alignability which is caused at the time of conveying the sheet bundle.

BRIEF DESCRIPTION OF THE DRAWINGS

The above and other objects and features of the invention are apparent to those skilled in the art from the following referred embodiments thereof when considered in conjunction with the accompanied drawings, in which.

DESCRIPTION OF THE PREFERRED EMBODIMENTS

Figure 1:
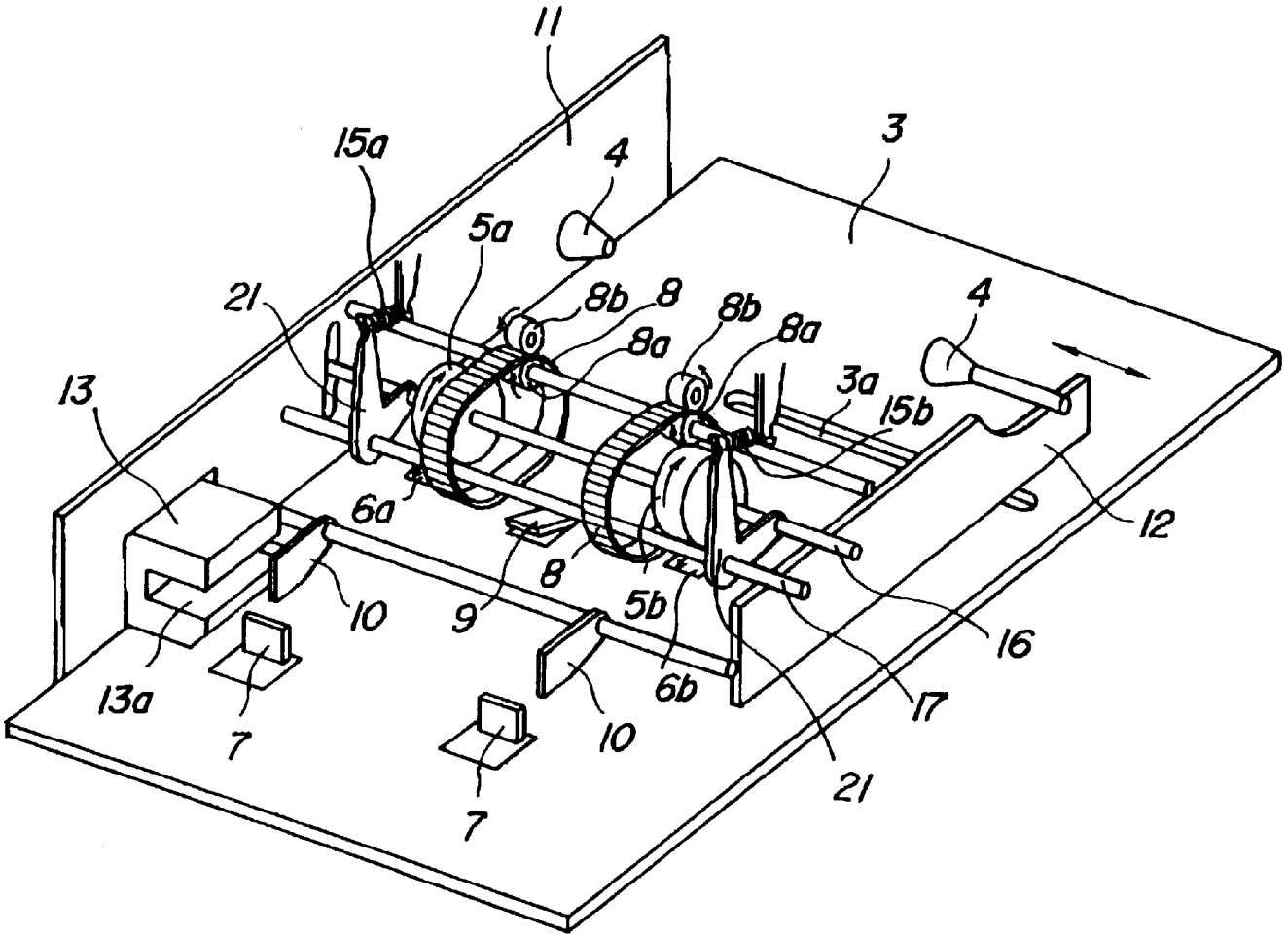
FIG. 1 is a perspective view showing a sheet processing apparatus according to a first embodiment.

An embodiment of a sheet processing apparatus to which the present invention is applied will hereinafter be specifically described by referring to the drawings. The following description will exemplify a sheet processing apparatus utilized in an image forming apparatus such as a copying machine or the like.

[First Embodiment]

Figure 2:
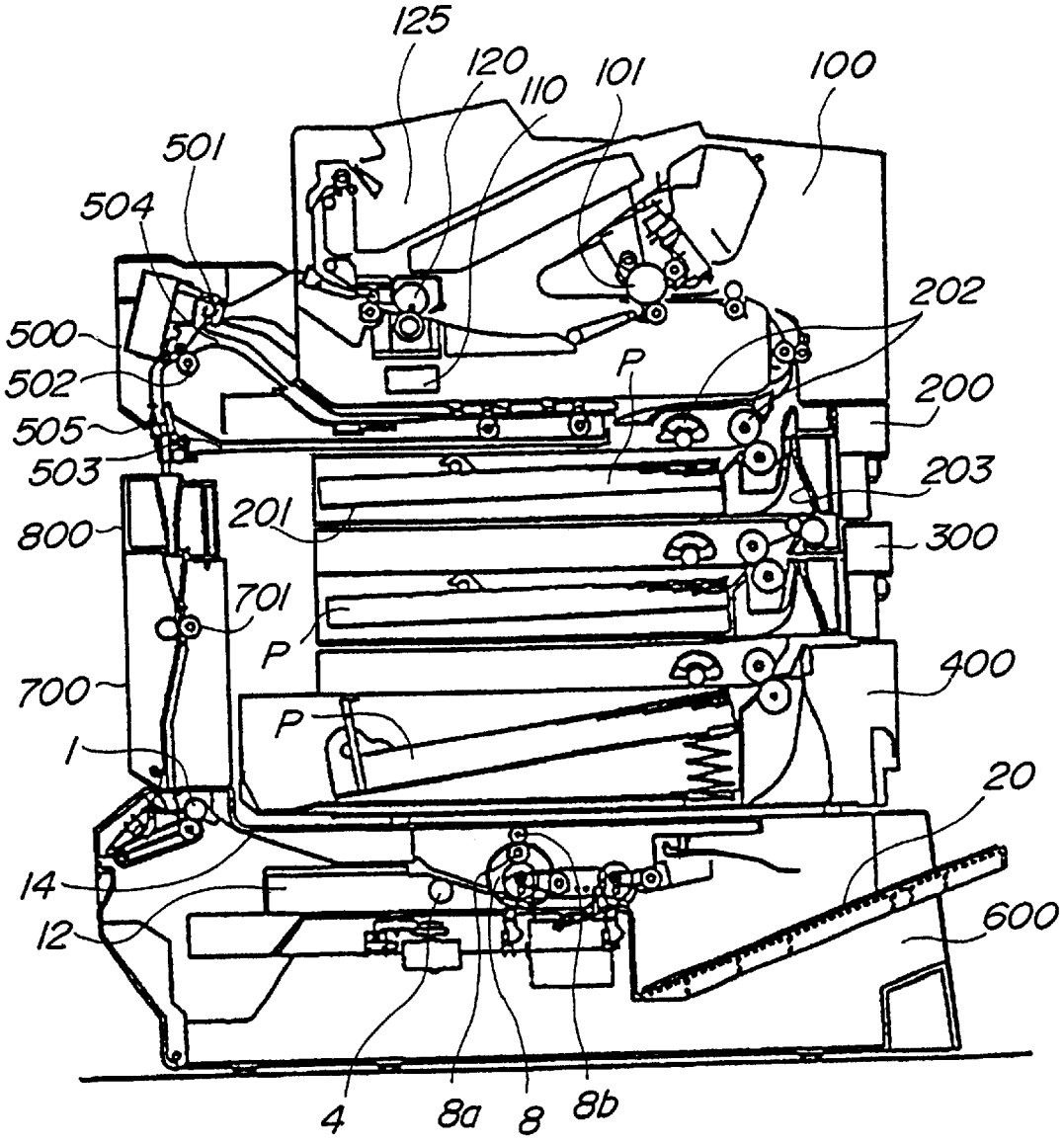
FIG. 2 is a schematic structural view showing an image forming apparatus having the sheet processing apparatus according to the first embodiment.
Figure 3:
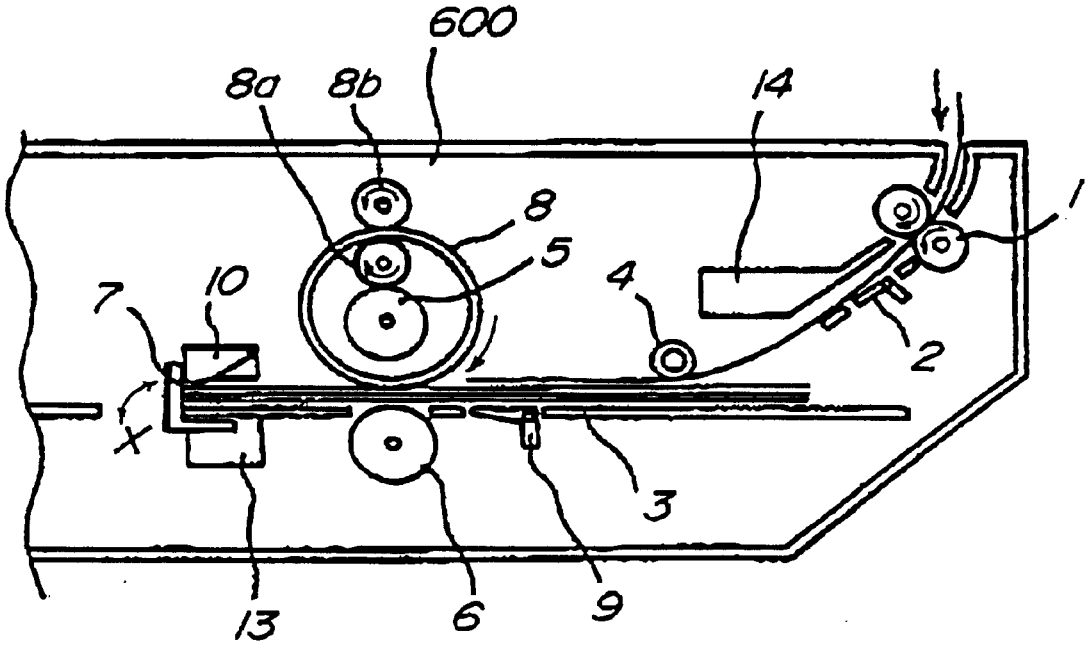
FIG. 3 is a cross-sectional view showing the sheet processing apparatus according to the first embodiment.
Figure 4:
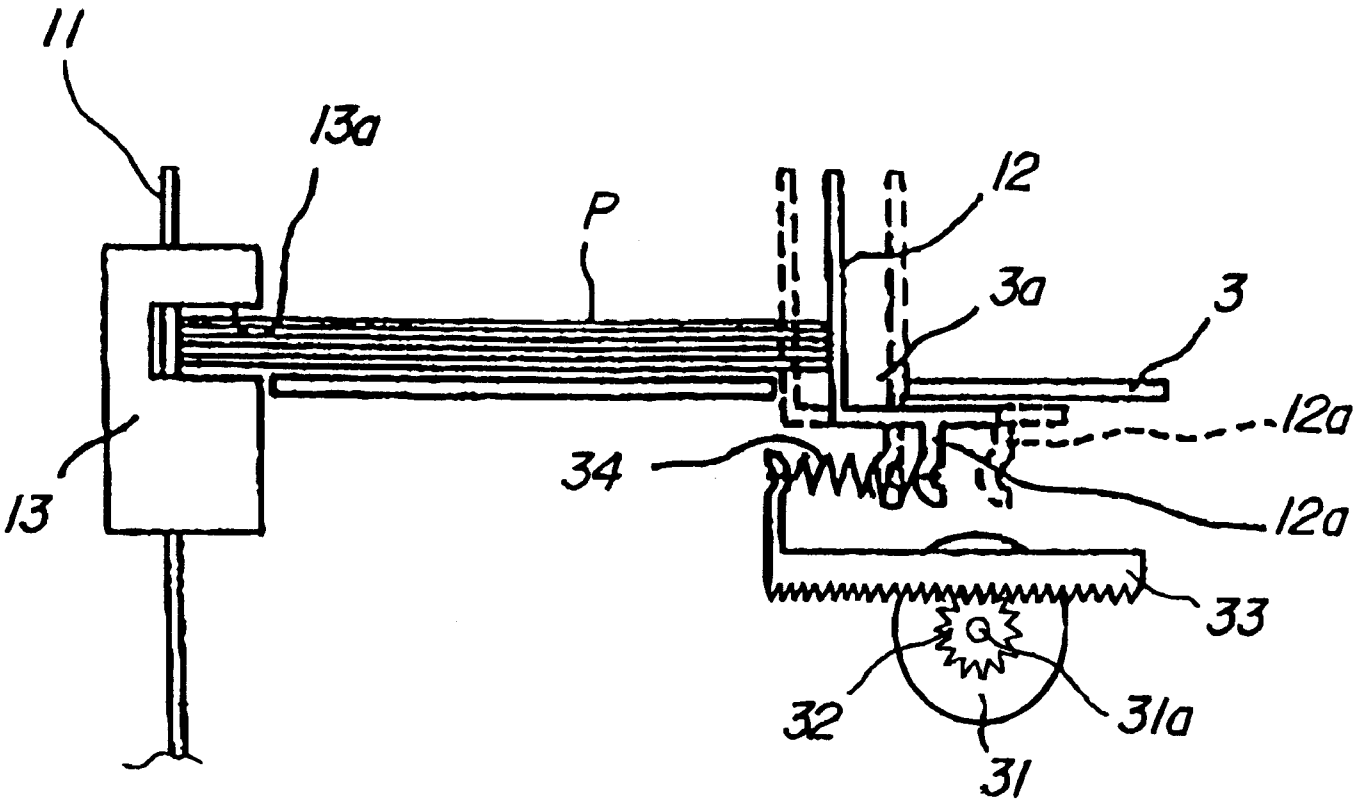
FIG. 4 is a cross-sectional view explaining an aligning operation of the sheet processing apparatus according to the first embodiment.
Figure 5:
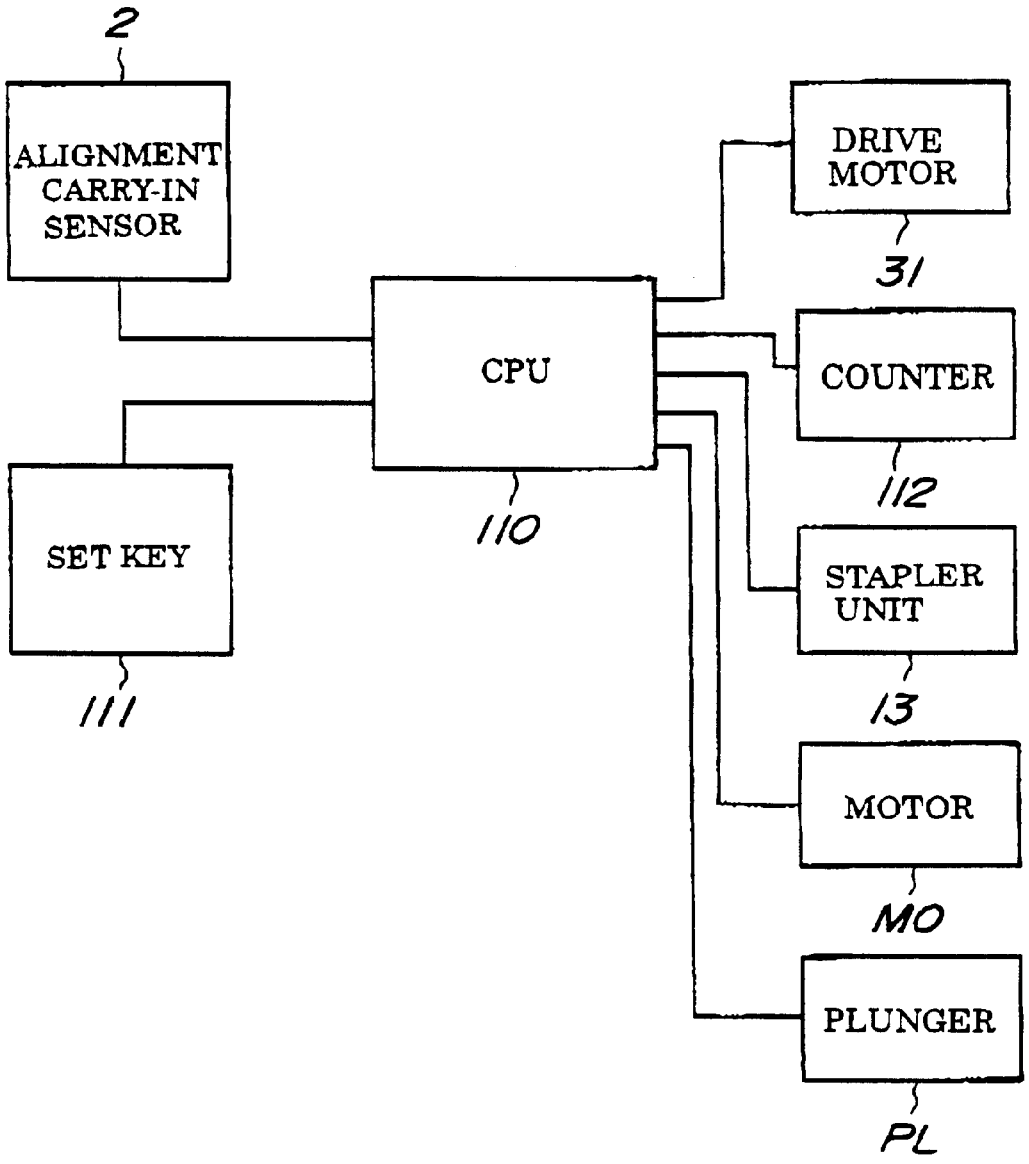
FIG. 5 is a control block diagram of the sheet processing apparatus according to the first embodiment.

A sheet processing apparatus according to a first embodiment will be described in detail with reference to FIGS. from 1 to 7. FIG. 1 is a perspective view showing a sheet processing apparatus according to a first embodiment; FIG. 2 is a schematic structural view showing an image forming apparatus having the sheet processing apparatus according to the first embodiment; FIG. 3 is a cross-sectional view showing the sheet processing apparatus according to the first embodiment; FIG. 4 is a cross-sectional view explaining an aligning operation of the sheet processing apparatus according to the first embodiment; and FIG. 5 is a control block diagram of the sheet processing apparatus according to the first embodiment.

In FIG. 2, numeral 100 refers to a main body of a printing apparatus, and the main body 100 of the printing apparatus is connected a computer independently or connected to a network such as LAN or the like to record, based on the information transmitted therefrom, a toner image on a sheet P such as a paper or the like through an image forming process.

In other words, the main body 100 of the printing apparatus forms the toner image on a photosensitive drum 101 based on predetermined printing signals through the image forming process. The toner image is transferred in a transfer section onto the sheet P, which is sheet-fed selectively from a desired sheet-feed cassette, and is thereafter fixed on the sheet P by a fixing means 120.

It is to be noted that a first sheet-feed apparatus 200 is provided below the main body 100 of the printing apparatus. The first sheet-feed apparatus 200 includes a detachable sheet-feed cassette 201 containing a plurality of sheets P and a separation sheet-feed portion 202 for separating, sheet by sheet, the sheets P contained in the sheet-feed cassette 201 by a predetermined sheet-feed signal and conveying the sheet thus separated into the main body 100 of the printing apparatus. The first sheet-feed apparatus 200 includes a sheet guide portion 203 for leading a sheet, fed from a second sheet-feed apparatus 300 or a third sheet-feed apparatus 400 which are placed below the first sheet-feed apparatus 200, to the main body 100 of the printing apparatus.

The sheet P where the toner image has been fixed as mentioned above is then branchingly conveyed, based on a predetermined signal, selectively into a sheet-delivery portion 125 prepared above the main body of the printing apparatus or into a double-sided conveying unit 500.

The double-sided conveying unit 500 includes a double-sided conveying sensor 501 working by passing of the sheet P thus branchingly conveyed. When a printing signal for directing a double-sided printing operation is outputted by operation of an operator, a CPU 110 as a control means drives a downstream double-sided conveying roller 502 at a predetermined timing so that the sheet is led to a reverse-conveying path 503 by passing of the sheet P through the double-sided conveying sensor 501. Then, the CPU 110, when detecting passing of a rear end of the sheet through the double-sided conveying sensor 501 starts reversely conveying the double-sided conveying roller 502 at a predetermined timing. Due to this, the sheet P is conveyed to a double-sided conveying path 504 and re-conveyed to the main body 100 of the printing apparatus where an image is formed on a remaining unprinted surface of the sheet.

In the case that the sheet then heads off to a sheet-bundle binding apparatus 600 as a sheet processing apparatus from the double-sided conveying unit 500, when the sheet activates the double-sided conveying sensor 501, the downstream conveying roller 502 is driven at a predetermined timing. Next, a flapper 505 is rotated to form a conveying path so that the sheet P is conveyed from an extension guide section 800 via a vertical conveying section 700 toward the side of the sheet-bundle binding apparatus 600.

The sheet P, after passing through the extension guide section 800 to be conveyed to the vertical conveying section 700, is then led to the sheet-bundle binding apparatus 600 by a vertical conveying roller pair 701 and then conveyed into a sheet alignment section by an alignment carry-in roller pair 1.

Next, the sheet-bundle binding apparatus 600 according to the present embodiment where the present invention is applied will be described in detail.

In the sheet-bundle binding apparatus 600, the sheet, which has formed an image, as mentioned above, by the main body 100 of the printing apparatus and has thereafter been conveyed from the main body 100 of the printing apparatus via the vertical conveying section 700 and the extension guide section 800, is to be bundled up at the alignment section to be subjected to a binding process at one or more spots.

In the sheet-bundle binding apparatus 600, as shown in FIG. 3, there is arranged the alignment carry-in roller pair 1 at an entrance through which the sheet P is carried in from the vertical conveying section 700. In a vicinity of the alignment carry-in roller pair 1, there is arranged an alignment carry-in sensor 2 as a detecting means for detecting the sheet P entering into the sheet-bundle binding apparatus 600. The alignment carry-in sensor 2 is to detect a carry-in timing of the sheet P and then, after a predetermined time, activate an alignment moving wall 12 described later by the CPU shown in FIG. 5. In addition, opposite to the alignment carry-in sensor 2, there is arranged an upper guide 14 for guiding the conveyance of the sheet P. The sheet P after passing through the alignment carry-in sensor 2 is aligned on a stacking tray 3 as a sheet stacking portion. The stacking tray 3 includes a sheet detecting sensor 9 as a sheet presence-absence detecting means for detecting the presence or absence of the sheets, as well as, a curl pressing lever 10 for holding upward floating such as a curl or the like of the sheet P stacked on the stacking tray 3.

The sheet alignment section comprises, as shown in FIG. 1, an alignment reference wall 11, provided in a standing manner on the stacking tray 3, as an aligning member to be directly contacted with one end in a widthwise direction perpendicular to the conveying direction of the sheet P, the alignment moving wall 12 (FIG. 4) having an engaging-stopping portion 12*a* at its bottom surface and forming an L shape which moves forward and backward with respect to the alignment reference wall 11 and which faces opposite to the alignment reference wall 11 via the sheet so as to align the sheet in the widthwise direction, sheet stoppers 7 for aligning a front end of the sheet P conveyed onto the stacking tray 3 by the alignment carry-in roller pair 1, and a plurality of ring-shaped longitudinal alignment belts 8 arranged on the same axis along the widthwise direction of the sheet P, the belts 8 being rotary driven by drive rollers 8*a* contacting on an inner peripheral surface of the respective belt 8 so as to press the front end of the sheet to the sheet stoppers 7. It is to be noted that, the sheet stopper 7, as shown in FIG. 5, is structured in a manner of being capable of appearing and disappearing, rotatively driven by a clutch (not shown) when the CPU 110 understands that a predetermined number of sheets P set by a set key 111 is counted by a counter 112, so as to move to a sheet stop position as well as to an escape position with respect to the stacking tray 3. In addition, referring to FIG. 1, a driven roller 8*b* which is supported rotatably to a leaf spring (not shown) is contacted on an outer periphery of the longitudinal alignment belt 8, which is opposite to the drive roller 8*a,* where the longitudinal alignment belt 8 is structured so as to be rotated in a manner of being sandwiched between the driven roller 8*b* and the drive roller 8*a*.

The stacking tray 3 forms a slit 3*a* for moving the alignment moving wall 12 as shown in FIG. 1 and FIG. 4. The slit 3*a* is penetrated by the engaging-stopping portion 12*a* contacting, in a protruding manner, on the bottom surface of the alignment moving wall 12. Between the engaging-stopping portion 12*a* and a rack 33 receiving driving power by engaging with a pinion 32 for driving which is supported by an axis 31*a* of a drive motor 31 as a drive means, there is tensely provided a spring 34 urged so as to narrow a width of the sheet P. With this arrangement, the rack 33 moving by the rotation of the pinion 32 for driving is pulled or pushed by the spring 34 so that the alignment moving wall 12 is movable along the width direction of the stacking tray 3. In other words, the sheet alignment section has such a function that, every time the sheet P is stacked, sheet by sheet, on the stacking tray 3 between the alignment reference wall 11 and the alignment moving wall 12, the alignment moving wall 12 is to press a side of the sheet P several times toward the alignment reference wall 11 with a predetermined pressingly pushing force, thus to align the end portion of the sheet bundle. The other end portion of the sheet bundle pressingly pushed by the alignment moving wall 12 is to be directly contacted with the alignment reference wall 11, thereby aligning the side position.

In addition, in the sheet-bundle binding apparatus 600, conical rollers 4 (See, FIG. 1) for suppressing curls in the widthwise direction of the sheet P are axially supported to the side of the alignment reference wall 11 and to the side of the alignment moving wall 12, and also, two swinging rollers 5*a,* 5*b* are supported on the same axis along the widthwise direction of the sheet P. The swinging rollers 5*a,* 5*b* are supported so as to be movable up and down at a predetermined timing by means of a clutch (not shown). Opposite to the swinging rollers 5*a,* 5*b* respectively, there are conveying rollers 6*a,* 6*b* being mounted in a manner of facing outward from the stacking tray 3. It is structured that both of the swinging rollers 5*a* 5*b* and the conveying rollers 6*a,* 6*b* are in synchronization with each other by a drive motor MO so as to be rotary driven via the belt. Only the rollers 6*a,* 6*b* may be rotated by the motor MO and the rollers 5*a,* 5*b* may be rollers. Since the alignment moving wall 12 has the drive motor 31, it can move in the forward and backward directions with respect to the alignment reference wall 11 in a state of keeping a parallel with the alignment reference wall 11.

Numeral 13 refers to a stapler unit as a sheet-bundle binding means for binding the sheet bundle with binding staples, and the stapler unit 13 is secured at a front end of the alignment position of the sheet P in parallel with the alignment reference wall 11. The stapler unit 13 is so constructed that a binding process operation is to be carried out in a process of passing the sheet P through concaved stapler portion 13*a* which ejects binding staples. Thus, the staple unit 13 performs stapling operation without moving in the conveying direction of the sheet P at all. It is to be noted that the stapler unit 13 is controlled by the CPU 110 so as to perform stapling operation after the swinging rollers 5*a,* 5*b* and the conveying rollers 6*a,* 6*b* convey the sheet bundle to a predetermined position.

Operation of the sheet-bundle binding apparatus 600 thus structured will be described.

The sheet P, on which a toner image formed on the photosensitive drum 101 of the main body 100 of the printing apparatus has been transferred in the transfer section, is then introduced and conveyed to an entrance of the sheet-bundle binding apparatus 600 by delivering rollers (not shown), the vertical conveying roller pair 701, and the like.

The sheet P thus carried in the sheet-bundle binding apparatus 600 is then conveyed by the alignment carry-in roller pair 1 along the upper guide 14. Then, when the alignment carry-in sensor 2 detects passing of the sheet P, the CPU 110, based on the detection signal, operates the alignment moving wall 12 after a predetermined time lapsed.

As shown in FIG. 3, the sheet P is still conveyed by the alignment carry-in roller pair 1, and then, while passing under the conical rollers 4 to make curls in the widthwise direction suppressed, the sheet P is conveyed to the stacking tray 3. The sheet P on the stacking tray 3 is conveyed in a downstream side in the conveying direction by a light conveying force of the longitudinal alignment belts 8, and then directly contacted with the sheet stoppers 7 where the front end side of the sheet P in the conveying direction is to be aligned. Since the conveying force of the sheet P by the longitudinal alignment belts 8 is set weak, the sheet P thus directly contacted with the sheet stopper 7 is not buckled, or, the sheet stopper 7 in the sheet stop position where the stopper is protruding from the stacking tray 3 is not rotated to the escape position where it is disappearing to the stacking tray 3. In addition, the swinging rollers 5*a,* 5*b* wait in an upper position and the conveying rollers 6*a,* 6*b* are not rotated, the sheet P to be conveyed by the longitudinal alignment belts 8 is to slide on the stacking tray 3 or on the sheet P located on the stacking tray 3. In other words, the front end in the conveying direction of the sheet P is to be aligned by the conveying force of the longitudinal alignment belts 8.

Next, aligning the widthwise direction perpendicular to the conveying direction of the sheet P will be described.

After a lapse of a predetermined time after the alignment carry-in sensor 2 detects the sheet P carried into the stacking tray 3, the CPU 110 drives the drive motor 31 to move the alignment moving wall 12.

Aligning operation in the widthwise direction of the sheet P is carried out every time the sheet P is stacked, sheet by sheet, on the stacking tray 3. As shown in FIG. 4, the alignment moving wall 12 can be moved among three positions an escape position (a), an aligning position (c), and a conveying position (b). In other words, the escape position (a) is such a case where a distance between the alignment reference wall 11 and the alignment moving wall 12 is wider than the sheet width; the aligning position (c) is such a case where a distance between the alignment reference wall 11 and the alignment moving wall 12 is narrower than the sheet width in which a difference between the aligning position (c) and the sheet width is smaller than a gap of the slit 3*a* where the alignment moving wall 12 is movable. In addition, the conveying position (b) is a case where a distance between the alignment reference wall 11 and the alignment moving wall 12 is approximately the same as the sheet width. When the sheet P is conveyed to the stacking tray 3, the alignment moving wall 12 located in the escape position (a) is to press the sheet P sequentially sheet by sheet to the alignment reference wall 11, thereby performing the aligning operation in the widthwise direction of the sheet P. At this moment, since the alignment moving wall 12 overlaps the aligning position (c) where the space between the alignment reference wall 11 and the alignment moving wall 12 is narrower than the sheet width, a tolerance of the width of the sheet P is absorbed, with the result that sheet P is surely pressed with respect to the alignment reference wall 11.

As mentioned above, the aligning operation in the widthwise direction of the sheet P is performed every time the sheet P is conveyed, sheet by sheet, to the stacking tray 3, and this operation is repeatedly continued until the time when a number of sheets, as a sheet bundle, set by the set key 111 are stacked on the stacking tray 3; the number of the sheets is counted with the counter 12. The sheet bundle thus obtained by carrying out all the steps is to be subjected to the binding process.

Next, a binding process operation of the sheet bundle will be described.

Figure 6A:
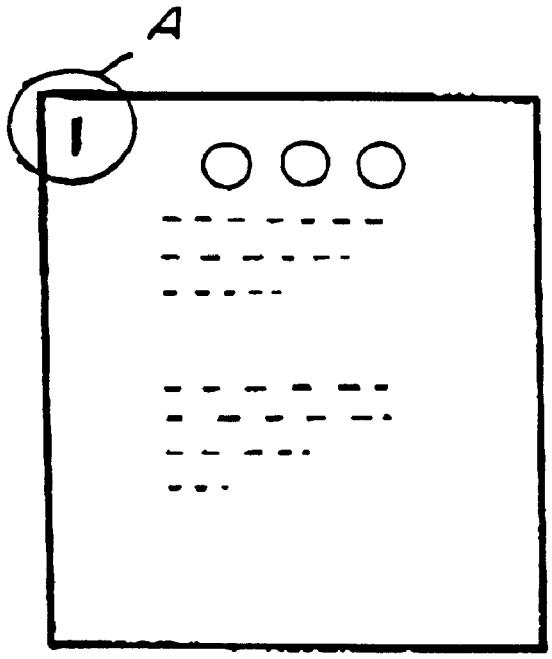
FIGS. 6(*a*) and 6(*b*) are typical views showing examplarily binding positions with respect to a sheet bundle.
Figure 6B:
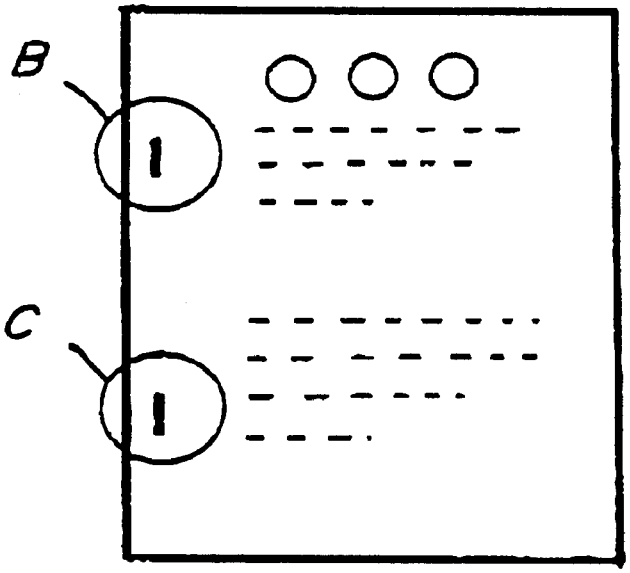

Since the stapler unit 13 is secured in parallel with the alignment reference wall 11 in a right upper portion in the sheet conveying direction, performing the stapling operation at this position can perform the binding process with respect to a corner of the sheet P. As a result, in the case of binding one spot of a corner A of the sheet P as shown in FIG. 6 (*a*), binding process is performed at the place where the sheet is aligned, without moving the aligned sheet bundle. Thereafter, the swinging rollers 5*a,* 5*b* are moved down to pinch the sheet bundle therebetween with the conveying rollers 6*a,* 6*b,* and also the sheet stopper 7 is to be escaped in the escape position as in an arrow X direction shown in FIG. 3. Accordingly, the sheet bundle can be conveyed, and the bundle conveyance is carried out by the swinging rollers 5*a,* 5*b* and the conveying rollers 6*a,* 6*b*, to deliver the sheet bundle to a delivery tray 20.

Also, in the case that two or more spots of the sheet bundle are subjected to the binding process, the sheet bundle is required to be moved to a position where the binding process is to be carried out. For example, in the case that two spots of a side portion B and a side portion C are subjected to the binding process as shown in FIG. 6 (*b*), the corner of the sheet bundle is not subjected to the binding process. In this case, after aligning the sheet bundle is completed, the swinging rollers 5*a,* 5*b* are moved down to pinch the sheet bundle therebetween with the conveying rollers 6*a,* 6*b*. Thereafter, the sheet stoppers 7 are escaped to the escape position so as to allow the sheet bundle to be conveyed, and the sheet bundle is conveyed by the swinging rollers 5*a,* 5*b* and the conveying rollers 6*a,* 6*b*. At this moment, the alignment moving wall 12 is located in the conveying position (b) where the alignment moving wall 12 has a distance approximately the same as the sheet width as shown in FIG. 4, and it is not placed in the position narrower than the width of the sheet P as in the time of aligning the sheet bundle, thus to be able to lower the resistance due to the alignment reference wall 11 and the alignment moving wall 12 at the time of conveying the sheet bundle.

Figure 7:
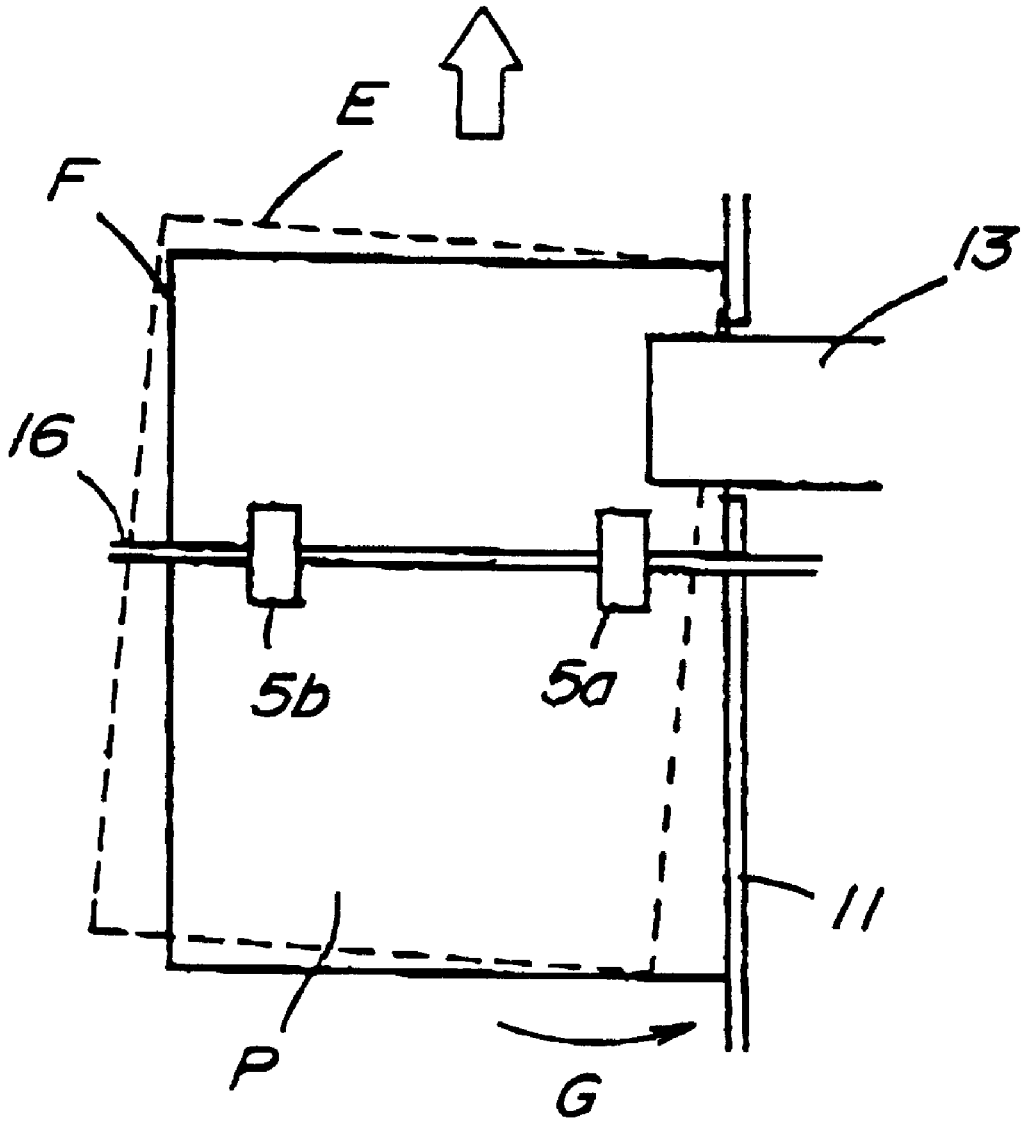
FIG. 7 is an explanation view showing a state of conveying the sheet bundle.

Here, as shown in FIG. 1, after driving force of a plunger PL is applied to a lever 21, the two swinging rollers 5*a,* 5*b* disposed, in the right and left positions, on the common axis move up on an axis 17 as a center of swinging movement against rollers. In addition, when the plunger is turned off, pressure is applied by two springs 15*a,* 15*b* disposed in the both ends of the axis, thus to provide the lever 21 with a rotating force in a right direction, and then the sheet bundle is pinched therebetween with the conveying rollers 6*a,* 6*b* to be conveyed. When the sheet bundle is being conveyed, the alignment moving wall 12 is located in the conveying position (b), but the alignment moving wall 12 is connected through the spring 34 as shown in FIG. 4, so when the sheet bundle pushes back with respect to the alignment moving wall 12 with a force stronger than the spring force, the alignment moving wall 12 cannot keep the conveying position, which might cause a situation E in FIG. 7 where the sheet bundle is inclined. In addition, when the springs 15*a* and 15*b* have the same tension, in other words, when the swinging rollers 5*a,* 5*b* have the same pressure for pinching the sheet bundle, the sheet bundle, if inclined when conveyed, cannot be corrected, and the sheet bundle is moved away from the alignment reference wall 11, which might be incapable of performing the binding process at the predetermined positions. Thus, by making the tension of the spring 15*a* in the side of the alignment reference wall higher than that of the other spring 15*b,* the swinging roller 5*a* in the side of the alignment reference wall is to have a pressure for pinching the sheet bundle higher than that of the swinging roller 5*b* of the other side.

In the present embodiment, the spring 15*a* in the side of the alignment reference wall is set 200 to 400 gf and the other spring 15*b* is set 50 to 100 gf. With this arrangement, the sheet bundle can receive a rotational force in a counterclockwise direction (G) toward the conveying direction, and therefore the sheet bundle can be kept in the state F in parallel with the conveying direction as the sheet bundle trying to incline is being pressed with respect to the alignment reference wall 11. Consequently, deterioration of the alignment property during the conveyance of the sheet bundle can be prevented.

The sheet bundle thus conveyed by a predetermined distance is to be stopped when the swinging rollers 5*a,* 5*b* and the conveying rollers 6*a,* 6*b* are stopped, and stapling process is performed without moving the stapler unit 13 at all. Then, the sheet bundle is conveyed again to the next stapling position at which all the stapling process is to be performed. After completing the staple process as mentioned above, the sheet bundle is delivered to the delivery tray 20.

The present embodiment, as mentioned above, has a structure in which each of the plural roller pairs 5*a,* 6*a,* 5*b,* and 6*b* disposed in the widthwise direction perpendicular to the sheet conveying direction has a pressure (pinching pressure by the spring 15*a,* 15*b*) different from that of the other roller pair for pinching the sheet bundle, and more specifically, it has a structure where the roller pairs 5*a,* 6*a* disposed in the side of the alignment reference wall have higher pressures for pinching the sheet bundle, and therefore the sheet bundle before subjected to the binding process can be conveyed as being pressed with respect to the alignment reference wall 11, with the result that the aligned sheet bundle can be conveyed with the aligned state maintained. Thus, the sheet bundle can certainly conveyed without disordering the alignment property of the sheet, and also processes such as binding or the like can be performed without disordering the alignment.

Thus, without moving the stapler unit 13 at all and by moving the sheet bundle without disordering the alignment property, a plurality of the sheets with high alignment property can be bounded and the mechanical section of the stapler unit 13 as well as the whole structure of the image forming apparatus can be simplified.

[Second Embodiment]

Figure 8:
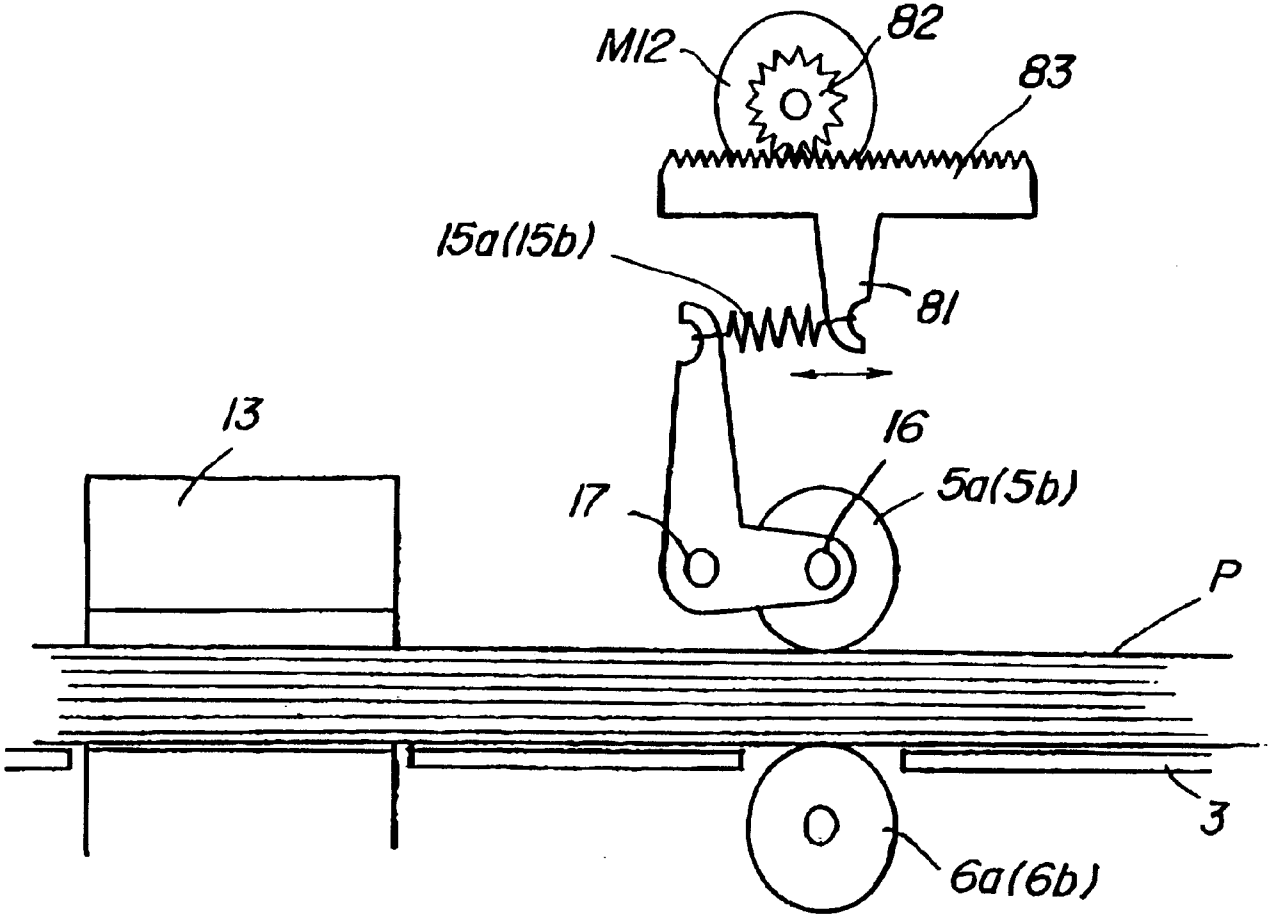
FIG. 8 is an enlarged view of an essential portion of a sheet processing apparatus according to a second embodiment.

A sheet processing apparatus according to a second embodiment will be described with reference to FIG. 8. FIG. 8 is an enlarged view of an essential portion of the sheet processing apparatus according to the second embodiment.

In the embodiment, a position of a hook 81 for catching the springs 15*a,* 15*b* as a pressurizing means with respect to the swinging rollers 5*a,* 5*b* is made movable by using a pinion gear 82 and a rack 83 of motor M12. With this arrangement, a nip pressure between the roller pair 5*a,* 6*a* (5*b,* 6*b*) can be set in a proper value according to a number of the sheets or a thickness of the sheet bundle. As a result, by carrying out a proper control in accordance with each of sheet bundles, the sheet bundle can be surely pressed with respect to the alignment reference wall, thus to improve the alignability.

[Third Embodiment]

Figure 9:
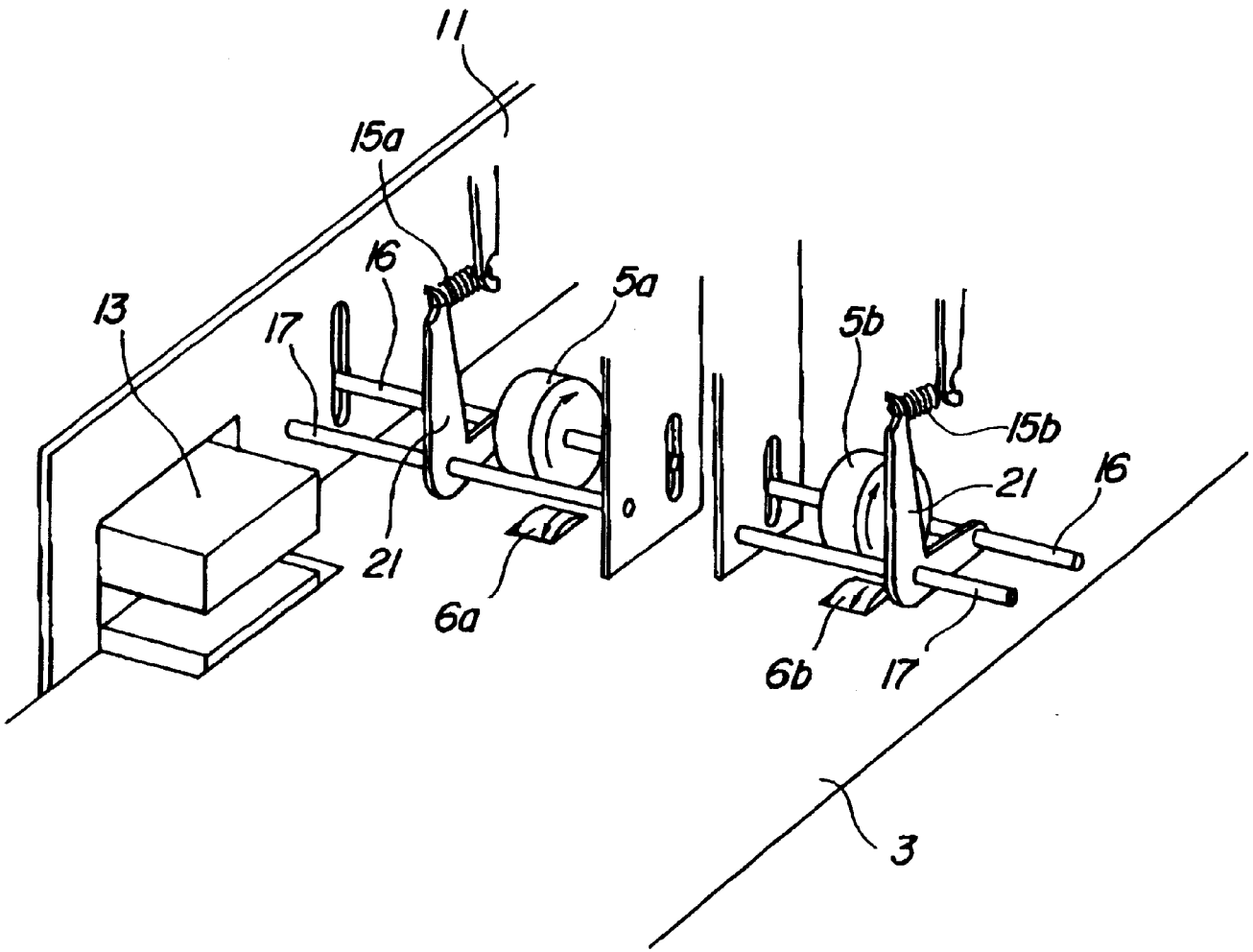
FIG. 9 is an enlarged view of an essential portion of a sheet processing apparatus according to a third embodiment.

A sheet processing apparatus according to a third embodiment will be described with reference to FIG. 9. FIG. 9 is an enlarged view of an essential portion of the sheet processing apparatus according to the third embodiment.

In the embodiment, the axes 16 for the swinging rollers 5*a* and 5*b* are formed separately. With this arrangement, the pressures for two rollers can be independently set completely, and therefore the sheet bundle can be surely pressed with respect to the alignment reference wall, thus to improve the alignability.

Furthermore, in the description of the embodiment, the pressure for pinching the sheet bundle is applied by placing and urging springs in the side of the swinging rollers 5*a,* 5*b,* but the invention is not limited to this; for example, if the springs are provided in the conveying rollers 6*a,* 6*b* or are provided respectively in both the rollers, it is needless to say that the same advantages can be obtained.

[Other Embodiments]

In the aforementioned embodiments, a copying machine is exemplified as an image forming apparatus, but the present invention is not limited to this; for example, other image forming apparatus such as a scanner, a printer, a facsimile apparatus or the like may be used, and, by applying the present invention to the sheet processing apparatus used in such an image forming apparatus, the same advantages can be obtained.

In addition, in the aforementioned embodiments, a sheet processing apparatus detachable with respect to the image forming apparatus is exemplified, but the present invention is not limited to this; for example, a sheet processing apparatus integrally formed in the image forming apparatus may be used, and, by applying the present invention to such a sheet processing apparatus, the same advantages can be obtained.

Further, in the aforementioned embodiments, a sheet processing apparatus for performing a process with respect to a sheet as an object to be recorded such as a recording paper or the like is exemplified, but the present invention is not limited to this; for example, when the present invention is applied to a sheet processing apparatus for performing a process with respect to a sheet as an object to be read such as an original document or the like, the same advantages can be obtained.

Further, in the aforementioned embodiments, an electrophotographic method is exemplified as a recording method, but the present invention is not limited to this; for example, other recording methods such as an ink jet method or the like may be used.

What is claimed is:

1. A sheet processing apparatus comprising:

a stacking portion for stacking a plurality of sheets to be made as a sheet bundle;

an alignment reference wall extending approximately in parallel with a conveying direction of the sheet bundle on one side of side surfaces of the sheet bundle;

a processing mechanical section for treating an aligned sheet bundle; and a plurality of belt pairs disposed in a direction approximately perpendicular to the conveying direction of the sheet bundle for conveying the sheet bundle in a pinching manner, wherein the plurality of belt pairs have different pressures for pinching the sheet bundle, and wherein, with respect to the plurality of the belt pairs, a belt pair disposed nearer the alignment reference wall is set to have a higher pressure for pinching the sheet bundle.

2. The sheet processing apparatus according to claim 1, further comprising a moving wall for aligning the sheet bundle by pressing the sheet bundle with respect to the alignment reference wall, wherein the moving wall presses the sheet bundle with a light force during the conveyance of the sheet bundle.

3. The sheet processing apparatus according to claim 2, wherein the processing mechanical section is a binding apparatus for binding the sheet bundle.

4. The sheet processing apparatus according to claim 3, wherein the binding apparatus comprises a stapler unit, wherein the stapler unit is not moved, and wherein a plurality of binding processes are performed on the sheet bundle after moving the sheet bundle by a predetermined distance with the plurality of the belt pairs.

5. The sheet processing apparatus according to claim 1, wherein each of the belt pairs can change the pressure for pinching the sheet bundle.

6. The sheet processing apparatus according to claim 1, further comprising a moving wall for aligning the sheet bundle by pressing the sheet bundle with respect to the alignment reference wall, wherein the sheet is delivered one by one to the stacking portion and aligned one by one to be the sheet bundle with the moving wall, and then the sheet bundle is conveyed when nipped by the belt pairs.

* * * * *

UNITED STATES PATENT AND TRADEMARK OFFICE

CERTIFICATE OF CORRECTION

PATENT NO. : 6,561,503 B1
DATED : May 13, 2003
INVENTOR(S) : Atsushi Ogata et al.

It is certified that error appears in the above-identified patent and that said Letters Patent is hereby corrected as shown below:

Column 2,
Line 7, "in" should be deleted.
Lines 22 and 40, "nearer" should read -- nearer to --.
Line 29, "conveyed" should read -- be conveyed --.

Column 3,
Line 14, "be" should be deleted.
Line 15, "described" should read -- be described --.
Line 21, "from" should be deleted.
Line 35, "connected" (1st occurrence) should read -- connected to --.

Column 7,
Line 3, "positions" should read -- positions: --.

Column 8,
Line 56, "staple" should read -- stapling --.
Line 67, "subjected" should read -- being subjected --.

Column 9,
Line 4, "conveyed" should read -- be conveyed --.

Signed and Sealed this

Eighteenth Day of November, 2003

JAMES E. ROGAN
*Director of the United States Patent and Trademark Office*